United States Patent [19]

Cornie et al.

[11] Patent Number: 4,853,182

[45] Date of Patent: Aug. 1, 1989

[54] METHOD OF MAKING METAL MATRIX COMPOSITES REINFORCED WITH CERAMIC PARTICULATES

[75] Inventors: James A. Cornie, North Chelmsford; Theodoulos Kattamis, Watertown; Brent V. Chambers, Cambridge; Bruce E. Bond, Bedford; Raul H. Varela, Canton, all of Mass.

[73] Assignee: Massachusetts Institute of Technology, Cambridge, Mass.

[21] Appl. No.: 104,173

[22] Filed: Oct. 2, 1987

[51] Int. Cl.[4] ..... C22C 1/10

[52] U.S. Cl. ..... 420/129; 420/590

[58] Field of Search ..... 420/129, 590

[56] References Cited

U.S. PATENT DOCUMENTS

| | | | |
|---|---|---|---|
| 2,752,666 | 7/1956 | Goetzel et al. | 29/182.8 |
| 3,053,706 | 9/1962 | Gregory et al. | 148/31 |
| 3,128,165 | 4/1964 | Bridwell et al. | 51/307 |
| 3,194,656 | 7/1965 | Vordahl | 420/590 |
| 3,447,921 | 6/1969 | Chang | 75/176 |
| 3,468,653 | 9/1969 | Herald et al. | 420/590 |
| 3,486,881 | 12/1969 | Meadows | 75/0.5 |
| 3,600,163 | 8/1971 | Badia et al. | 420/590 |
| 3,653,982 | 4/1972 | Prill | 148/31 |
| 3,728,108 | 4/1973 | Siffenlen et al. | 420/590 |
| 3,782,930 | 1/1974 | Shibata | 75/204 |
| 3,858,640 | 1/1975 | Siffenlen | 420/590 |
| 4,471,034 | 9/1984 | Romero et al. | 428/679 |
| 4,540,546 | 9/1985 | Giessen | 420/129 |
| 4,710,348 | 12/1987 | Brupbacher et al. | 420/129 |
| 4,748,001 | 5/1988 | Banerji et al. | 420/590 |
| 4,751,048 | 6/1988 | Christodoulou et al. | 420/129 |

*Primary Examiner*—L. Dewayne Rutledge
*Assistant Examiner*—David Schumaker
*Attorney, Agent, or Firm*—Thomas J. Engellenner

[57] ABSTRACT

Composite materials and methods for making such materials are disclosed in which dispersed ceramic particles are at chemical equilibrium with a base metal matrix, thereby permitting such materials to be remelted and subsequently cast or otherwise processed to form net weight parts and other finished (or semi-finished) articles while maintaining the microstructure and mechanical properties (e.g. wear resistance or hardness) of the original composite. The composite materials of the present invention are composed of ceramic particles in a base metal matrix. The ceramics are preferably carbides of titanium, zirconium, tungsten, molybdenum or other refractory metals. The base metal can be iron, nickel, cobalt, chromium or other high temperature metal and alloys thereof. For ferrous matrices, alloys suitable for use as the base metal include cast iron, carbon steels, stainless steels and iron-based superalloys.

8 Claims, 2 Drawing Sheets

METHOD OF MAKING METAL MATRIX COMPOSITES REINFORCED WITH CERAMIC PARTICULATES

The U.S. Government has rights in this invention pursuant to U.S. Department of Energy Contract No. DE-AC02-84-ER80143.

BACKGROUND OF THE INVENTION

The technical field of this invention is metallurgy and, in particular, the preparation of metal matrix composites reinforced with ceramic particulates.

Composites formed by the introduction of ceramics into matrices of softer base metals have gained wide acceptance for their cutting and wear resistant properties. The ceramics which are useful for such purposes are typically carbides of refractory metals, such as titanium carbide, tungsten carbide, zirconium carbide and the like. However, the techniques which are presently available for forming such composites are most often cumbersome and ill-suited for the manufacture of articles having complex shapes.

In one conventional process, composites can be formed by powder metallurgy techniques. A fine grained powder of a base metal, such as iron, is typically mixed with a ceramic powder, such as tungsten carbide, and then pressed into a compact. The compact is then sintered at a high temperature to allow interdiffusion between metal-metal and metal-ceramic particles and thereby form a composite in which the ceramic is dispersed through a base metal matrix. Composites have also been formed by sintering three-part powder mixtures of base metal, refractory metal and carbon (i.e. Fe-Ti-C mixtures) in which the carbide is formed by reaction of the refractory metal and carbon at the elevated temperature during sintering.

A number of problems limit the use of powder metallurgy techniques in the formation of hard and wear resistant composites. Considerable effort must be spent in thorough mixing of the powders to assure adequate uniform dispersion of the carbide. The sintering process itself must be monitored carefully to avoid thermal and mechanical stresses which can otherwise result in structural weakness. Moreover, mold design is typically limited to relatively simple shaped articles in order to prevent density differences in the compact and subsequent non-uniform shrinkage during sintering. Finally, sintered parts must often be trimmed or machined into final shape and the nature of refractory ceramic composites can make this particularly difficult; the hardness of the composites can quickly blunt or chip most other cutting tool edges.

Composites have also been formed by mixing ceramic powders directly into a molten or semi-solid base metal in a process known as compocasting. Although reasonably good results have been reported when ceramics have been mixed directly into low melting temperature metals such as aluminum, magnesium or zinc, considerable problems are encountered when the compocasting tecnhique is applied to high melting temperature base metals such as iron. In such instances direct stirring of the ceramic powder is difficult because of density differences and because of the lack of wettability of most ceramics. Direct stirring of ceramic powders into semi-solid slurries is also difficult due to erosion of mechanical stirring devices and non-uniform dispersion of particulates.

Moreover, composites formed by either sintering or compocasting suffer from an additional problem in that they are not well suited for remelting and casting. Typically, the fine dispersion and microstructure of the initial composite is lost during melting. When such composites are melted, the carbide components (i.e., the refractory metal and carbon) go into solution and undergo chemical reactions dependent on composition which most often lead to a modification of the original structure.

There exists a need for better materials for applications in which wear resistance or hardness is important. In particular, techniques which can efficiently produce metal matrix composites with a fine and uniform microstructure, as well as composite materials which can be remelted and cast while retaining their microstructure and structural properties would satisfy a long felt need in the field.

SUMMARY OF THE INVENTION

Composite materials and methods for making such materials are disclosed in which dispersed ceramic particles are at chemical equilibrium with a base metal matrix, thereby permitting such materials to be remelted and subsequently cast or otherwise processed to form net shape parts and other finished (or semi-finished) articles while maintaining the microstructure and mechanical properties (e.g. wear resistance or hardness) of the original composite.

The composite materials of the present invention are composed of ceramic particles dispersed in a base metal matrix. The ceramics are preferably carbides of titanium, zirconium, tungsten, molybdenum, hafnium, vanadium, niobium, tantalum, chromium, boron, silicon, mixtures thereof, or other refractory metals. The base metal can be iron, nickel, cobalt, chromium or other high temperature metal and alloys thereof. For ferrous matrices, alloys suitable for use as the base metal include cast iron, carbon steels, stainless steels and iron-base superalloys.

In one aspect of the invention, novel composites are disclosed. The composites provide a family of high melting point, metal-base materials with extremely high wear resistance characteristics. The composites have a metal matrix containing a dispersion of ceramic particles throughout it. The ceramic particles are, relatively, at chemical equilibrium with the matrix. The ceramic particle morphology can be modified and controlled by heat treatment to alter the structural and mechanical characteristics of the alloy system. In some instances, for example in the case of steel, both the matrix metal and the carbide particles can be modified and controlled. The resultant composite material can be cast directly in a mold to produce a shaped part or an ingot which can further be formed by standard mechanical metallurgical techniques.

The volume percent of ceramic particles in the composites can vary from about 5 percent to about 60 percent, more preferably from about 10 percent to about 50 percent and most preferably from about 20 percent to about 45 percent. The average particle size can range from about 2 microns to about 75 microns, more preferably from about 5 microns to about 50 microns and most preferably from about 5 microns to about 25 microns. In general, as the volume percent of the ceramic particles increases, so does the hardness and wear resistance of the composite. The ratio of the refractory element to carbon will depend upon the particular constituents and the nature of the chemical bonding but will generally range from about 70 weight percent to about 90 weight percent of refractory element to carbon in the ceramic particles. Hardness measurements of over 300 kg/mm$^2$ (Brinell scale) have been observed with the composites disclosed herein.

An example of this alloy system family is a metal-matrix/TiC composite material which is produced by adding titanium metal to a metal-carbon base alloy melt. The titanium and the carbon react to form a ceramic particulate precipitate, titanium carbide (TiC), which is one of the hardest ceramic materials. The precipitate can be evenly distributed throughout the samples produced, and supplies high abrasion resistance. The carbon required to react with the titanium can originate in the base metal alloy or can result from supplementary carbon (such as graphite) additions. Thus, iron, nickel, cobalt, chrome, and other high temperature alloys can be utilized as the base metal in this process. In the case of ferrous-base composites, the base metal can be pure iron, carbon steels, cast irons, iron-base superalloys, stainless steels, or other iron-base alloys, all with the appropriate amount of supplemental graphite. The ferrous base metal is melted to form a solvent for the reaction of Ti with carbon to yield TiC.

Wear tests on ingot samples produced from cast iron/TiC composite material showed extremely high abrasion resistance compared to standard materials. For example, when 15 micron TiC particles were present in a cast iron sample at a volume percent of 30, the relative wear life of this composite material was over 130 times that of plain carbon steel, over 25 times that of hardened steel, nearly 3 times that of a tungsten carbide tool bit, and approximately 10% higher than a similar cast iron/-TiC composite sample with 15 micron diameter particles present in the base metal at a 20 volume percent. Subsequent wear tests utilizing low carbon steel alloy as a standard, showed that when the TiC was present at 30 volume percent in a ferrous-base/TiC composite, relative wear life values higher than 230 times that of low-carbon steel were obtained. Hardness measurements of over 400 kg/mm$^2$ have been observed with the iron/-TiC composites, and hardness appears to increase with increasing volume percent of carbide.

In the samples cited above, the cast iron/TiC composites were slowly cooled during production. When the composites of the same chemistry were rapidly cooled, the matrix metal could also be hardened to further enhance the wear resistance of these new materials. The measured hardness of the matrix metal had been increased by over 65 percent by heat treating (rapidly cooling) the materials. In general, especially in the case of ferrous matrices, the metal matrix structure and properties can be varied and controlled relatively independently of the precipitate. These changes can be made at any time following the original composite production.

The new composite materials can be conventionally formed at elevated temperatures. For example, reductions in height in excess of 65% were demonstrated during forging trials at approximately 1000° C. with a constant strain rate of $1.7\times10^{-3}\,\text{sec}^{-1}$, without internal cracking. Other elevated temperature forming operations can be utilized, such as rolling, drawing, extruding and so forth. However, the material exhibits such superior wear resistance at room temperature, that diamond tools and other hard ceramics must be employed for machining.

In another aspect of the invention, a process is disclosed whereby a refractory metal is added to carbon-containing, molten, primary or base metal. The base metal becomes the metal matrix of the resulting composite, while the refractory metal after reaction with carbon in the molten solution, forms ceramic precipitates.

The refractory or other secondary material can be added in the form of a thin strip, a tube, a rod, a flat plate, multiple shapes thereof, multiple pellets, flakes or other shapes, a stream of liquid metal, a continuous or discontinuous stream of gas, or multiple streams of liquid or gas, for example. The amount of secondary material will determine the final volume fraction of precipitate so long as there is sufficient carbon in the molten solution.

In one series of investigations, a Series 40 gray cast iron (Fe, 3.7%C, 0.3%Mn, 2.5%Si) was used. Small amounts of supplementary carbon were sometimes added in order to achieve the desirable carbide particle volume percent. The base metal alloy was melted under a protective atmosphere and superheated to approximately 1750° C. Titanium rod of ¼ inch diameter was added to the superheated liquid by pushing it to the bottom of the crucible. During addition, the rod was also used as a stirrer to aid in the mixing process. The titanium rod was dissolved into the base metal alloy. As the temperature of the resultant alloy decreased, the titanium in solution reacted with carbon in the base metal alloy to produce titanium carbide particles which precipitated from the melt. The ingot was then allowed to cool in the crucible.

Rectangular ingots of the composite which have approximately 30 volume percent of very fine, well distributed TiC precipitate particles throughout the ingot were repeatedly cast in-situ. The volume of precipitate can be controlled to be from less than 10 to over 60 percent. The particle size of the TiC was approximately 15 microns but could vary from as small as a few microns to over 50 microns.

Most generally, this precipitation process can be utilized for all base metal alloys where there is a constituent in sufficient content (i.e., carbon, in our example) to react with a secondary material addition (i.e., titanium) and produce a precipitated phase (i.e., TiC) which modifies one or more properties (i.e., desired higher abrasion resistance) of the base metal product. The base metal composition can be modified by supplementing the reacting species, such as carbon. Thus, the precipitation process can be applied to a wide range of metallic elements and alloys.

In yet another aspect of the invention, composite materials are disclosed in which the ceramic particles and the matrix are at relative chemical equilibrium. Since the ceramic particles of the composite in the present invention were originally formed by precipitation from solution, the composition of the composite and, hence, the volume percent and other general characteristics of the ceramic components have already been defined. Consequently, the composites of the present invention can be formed as ingots or pellets, and then remelted and reformed with the same composition and properties as were obtained during the original forming. For example, in iron-based/TiC composite, the entire sample can be reheated to a fully liquid form and recast to produce a second ingot or a net-shaped part. The second ingot can have the same structure as the original ingot, provided that the thermal history (time at temperature, temperature, cooling rate, and so forth) of the second casting is the same as the thermal history of the first casting.

The invention will next be described in connection with certain illustrated embodiments; however, it should be clear that various additions, subtractions and modifications can be made without departing from the spirit or scope of the invention. The ceramic particles can vary in size and shape; they can be faceted, ovular, clustered, dendritic, and with smooth or rough surfaces. Although the invention is primarily described in connection with carbide ceramics, other ceramic compositions, such as borides and nitrides, can also be prepared by analogous techniques. Variations in the thermal processing of the composites can also be practiced; during formation of the solid solutions, faster cooling rates will typically produce smaller ceramic particles for a given alloy, while slower cooling rates will produce fewer, larger ceramic particles. The particles can also be coarsened or smoothened by appropriate heat treatment. In addition, the base metal alloy can be hardened or tempered, as is known in the art.

Although the working examples reported below involve the addition of a solid refractory metal to a superheated, carbon-containing molten base metal or alloy, the refractory metal can also be melted first and added to the base alloy as a liquid. The refractory metal would still go into solution and undergo in-situ reacton to form the carbide ceramic precipitate. This technique may be particularly useful in direct casting of finished (or semi-finished) parts. By melting the base matrix-metal and a secondary metal separately and pouring the two liquid metals together into a mold, better mixing by forced convection could occur, and the fluidity of the secondary metal would aid in the production and distribution of the ceramic particles. Also, the metals could be poured together into the mold resulting in a part cast to final shape.

DETAILED DESCRIPTION

The invention will next be described in connected with the following non-limiting examples.

Composites according to the present invention were prepared by precipitating the carbide from an Fe-Ti-C melt of appropriate composition. Small specimens (5–10g) were processed by melting a piece of cast iron (3.8wt % C.) in a high frequency induction furnace under argon and adding the amount of titanium yielding a volume fraction TiC of 0.20 to 0.35. The samples were contained in small graphite crucibles or supported by BN substrates.

Two nominal compositions were used: Type A alloy (Fe-16.88% Ti-4.10% C.) yielding a volume fraction carbide $V_f=0.3$ and Type B (Fe-10.88% Ti-5.8% C.) yielding $V_f=0.2$. Melts were nucleated at about 10° C. below the TiC liquidus and subsequently water-quenched (500° C./s), or argon-cooled (100° C./s) or slowly-cooled in the furnace with the power on (1.6° C./s). Specimens of both alloys with identical geometries were reheated at 1340° C., a temperature at which unmelted TiC cores are surrounded by liquid, and held for 20 min, 2, 4 and 6h prior to argon-cooling, in order to evaluate the effect of ripening kinetics on carbide geometry. Larger ingots (2.5–3 Kg) of composite were processed in a 10KHz induction furnace under argon. Specimens of a wide range of average compositions were taken from these ingots and were surface-scanned with an electron beam and a gas-tungsten arc at different power inputs and scanning velocities, in order to study the effect of rapid cooling on carbide shape and size.

The microstructure of small Type A alloy specimens nucleated at 10° C. below the carbide liquidus and cooled at three rates, consisted of carbide particles dispersed in a steel matrix. The average particle size, $\bar{d}$ (mean lineal intercept) increased and the particle number density, N (number of particles per unit area of cross-section) decreased with decreasing cooling rate, while the base metal structure varied from martensitic to pearlitic. Similar observations were made on Type B alloy specimens in which the matrix consisted of proeutectic cementite laths with ternary eutectic (pearlite islands and fine TiC particles in a cementite matrix). The faceted growth tendency of the carbide increased with increasing carbon content and decreasing growth rate.

Figure 1:
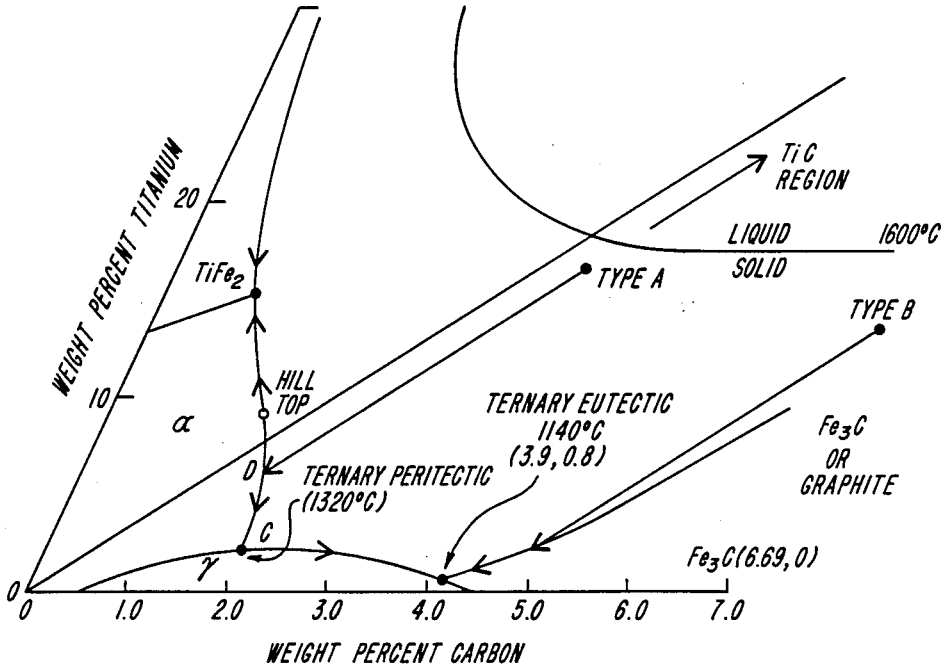
FIG. 1 is the iron-rich corner of a Fe-Ti-C phase diagram illustrating the solidification behavior of certain composites prepared according to the present invention.

FIG. 1 illustrates a Fe-Ti-C phase diagram. During cooling of the Type A melt, TiC crystals nucleated and grew, while liquid composition moved toward a point D where $\alpha$-ferrite nucleates. During further cooling, the liquid followed the eutectic valley while the ferrite dendrites and the TiC particles grew. At the ternary peritectic C (1320° C.), the dendrites were transformed into austenite. This transformation continued in the solid state, while more $\gamma$ and TiC coprecipitated down the eutectic valley to the ternary eutectic TE (1140′ C.), at which solidification was completed. Following the solidification path of Type B melt, the final microstructure consisted of a dispersion of TiC particles in a matrix of $Fe_3C$ laths, which was independent of cooling rate, with ternary eutectic between the laths.

The microstructure of Type A and B alloy specimens was studied by holding the specimens at 1340° C. for 20 min and 6h. The average particle size, $\bar{d}$, increased with time and the specific particle surface area, $S_v$ (TiC surface-to-volume ratio) decreased, clearly indicating the operation of ripening (coarsening). To further determine the prevalent coarsening mechanism, $\bar{d}^{-3}-\bar{d}$HD $o^{-3}$, and $\bar{d}^{-2}-\bar{d}_o^{-2}$, where $\bar{d}_o$ is the average particle size at any time when steady state growth has begun, were plotted versus isothermal holding time. Theory predicted a cubic relationship. A square relationship would have indicated either diffusion-controlled ripening in presence of convection, or interface kinetics-controlled ripening, which would normally be expected for faceted phases. The experimental points fit the cubic power relationship closer than they did the square power. Hence, diffusion through the liquid with little or no contribution from convection appeared to control final average particle size and not interface attachment kinetics, as would have been expected of normally faceted phases.

Figure 2:
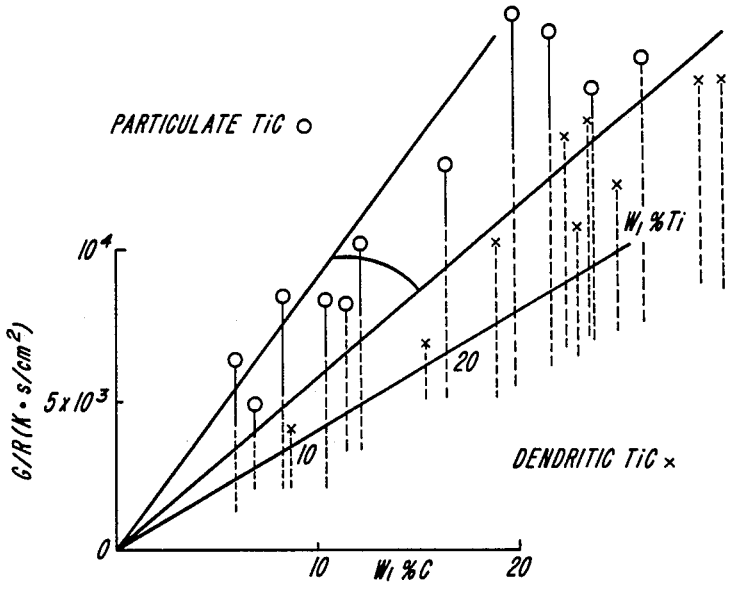
FIG. 2 is a graph illustrating the relationship beteeen the G/R ratio, weight percentage of titanium and weight percentage of carbon in Fe-Ti-C composites prepared according to the present invention.

The microstructrues of two electron beam beads-on-plate deposited on Type B alloy specimens also were studied. The first bead contained undissolved TiC particles of the same average size as those in the base metal, embedded in a typical Type B cementite matrix. In the second bead, TiC particles of the base metal dissolved to a large extent and during cooling TiC particles with dendritic tendencies grew prior to the growth of the matrix cemetite. Additionally, a transverse section of a gas-tungsten arc bead-on-plate deposited on Type A alloy was examined. The pre-existing TiC particles were fully dissolved and the carbide reprecipitated dendritically during cooling. In this case, the titanium and carbon concentrations were higher than in the case of TiC particulates and the G/R ratio, where G is the thermal gradient (° C./cm) in the liquid at the carbide-liquid interface and R is carbide growth velocity (cm/sec), was presumably low enough to yield surface instability. In order to determine the conditions for which instability occurs, the concentrations of carbon and titanium in the weld pool at the onset of solidification, and the prevailing G/R ratios were approximately determined. The concentrations were measured by electron microprobe analysis in the matrix between undissolved carbide particle. The G/R ratio for the carbides was approximated by that in the matrix. Several specimens of Type A and B alloys were solidified at various cooling rates and secondary dendrite arm spacing was plotted versus cooling rate. Through extrapolation of this curve, the average cooling rate (GxR) was deduced for each bead, for which R was calculated from the beam velocity, V, from: $R=V\cos\alpha$, where $\alpha$ is the angle is that between R and V, measured on the top section of the bead. Hence, G/R was determined and illustrated in FIG. 2.

What is claimed is:

1. A process for preparing a metal matrix composite reinforced with ceramic particulates, the process comprising:

adding a refractory metal to a carbon-containing molten base metal to form a solution;

allowing the reaction of said refractory metal and carbon, and the precipitation of a resulting refractory metal carbide from said solution; and controlling the temperature during cooling of the solution such that a solid composite is formed having a base metal matrix reinforced with particulates of the precipitated carbide ranging from about 2 microns to about 75 microns in average size.

2. The process of claim 1 wherein the base metal is selected from the group consisting of iron, nickel, cobalt, chromium, steel and alloys thereof.

3. The process of claim 1 wherein the refractory metal is selected from the group consisting of titanium, zirconium, tungsten, molybdenum, hafnium, vanadium, niobium, tantalum, chromium, boron, silicon and mixtures thereof.

4. The process of claim 1 wherein the step of adding a refractory metal further comprises adding an amount of refractory metal sufficient to yield a volume percent of ceramic particles ranging from about 5 percent to about 60 percent.

5. The process of claim 4 wherein the volume percent ranges from about 10 percent to about 50 percent.

6. The process of claim 4 wherein the volume percent ranges from about 20 percent to about 45 percent.

7. The process of claim 1 wherein the average particle ranges from about 5 microns to about 25 microns.

8. The process of claim 1 wherein the process further comprises forming the composite into pellets or ingots suitable for remelting and casting into shaped articles.

* * * * *